United States Patent [19]

Cline

[11] Patent Number: 4,850,286

[45] Date of Patent: Jul. 25, 1989

[54] FOLDABLE TRAY ASSEMBLY

[76] Inventor: Jack B. Cline, 12827 Bromwich St., Arleta, Calif. 91331

[21] Appl. No.: 273,951

[22] Filed: Nov. 21, 1988

[51] Int. Cl.[4] ..... A47B 3/02

[52] U.S. Cl. ..... 108/118; 108/121

[58] Field of Search ..... 108/115–121, 108/145

[56] References Cited

U.S. PATENT DOCUMENTS

| | | | |
|---|---|---|---|
| 739,999 | 9/1903 | Engle | 108/116 |
| 755,103 | 3/1904 | Boyd | 108/120 X |
| 2,426,514 | 8/1947 | Long | 108/119 X |
| 3,841,699 | 10/1974 | Thomas | 108/119 X |
| 3,906,848 | 9/1975 | Gow | 108/118 |
| 4,034,684 | 7/1977 | Carson et al. | 108/116 X |

FOREIGN PATENT DOCUMENTS

| | | | |
|---|---|---|---|
| 3104182 | 12/1981 | Fed. Rep. of Germany | 108/117 |

*Primary Examiner*—Peter A. Aschenbrenner
*Attorney, Agent, or Firm*—Jack C. Munro

[57] ABSTRACT

A foldable tray assembly which includes a tray which is locatable in a usable position with the upper surface of the tray being substantially horizontal. In the usable position, the tray assembly is located in a cantilevered position as is also the base of the tray assembly. When a human being is sitting in a chair or sofa, the base can be easily moved underneath the chair with the tray being movable to a position directly over the lap of the human being.

10 Claims, 1 Drawing Sheet

FOLDABLE TRAY ASSEMBLY

BACKGROUND OF THE INVENTION

The field of this invention relates to foldable tray assemblies and more particularly to a tray which facilitates its location in conjunction with a seated human being thereby eliminating the need to have the tray assembly to be located forward of the seated human being.

The usage of foldable tray assemblies is well-known. Such tray assemblies are commonly manufactured and sold as a "TV Tray" (television tray). These trays are commonly used in conjunction with individuals that are seated in chairs and sofas. The common usage for such a tray is for the purpose of eating while watching television.

The TV tray in its most common form utilizes a scissor linkage arrangement in order to move the tray from its usable position to its stowage position and vice versa. The scissor linkage arrangement is connected to both the front edge of the tray and the rear edge of the tray. The position of the scissor linkage assembly will prevent the tray from being moved directly over one's lap when the tray is being used. The scissor linkage assembly permits locating of the tray abutting the front edge of the chair or sofa. If perchance food and/or drink is spilled, in most cases such will fall directly onto the lap of the user as opposed to falling on the tray because the tray is located forwardly of the user's lap It would be desirable to design a TV tray assembly wherein the TV tray could be located directly over the lap of the user with the base portion of the tray being located underneath the chair or sofa upon which the user is seated.

SUMMARY OF THE INVENITON

The primary objective of the present invention is to construct a TV tray assembly wherein the TV tray portion of the tray assembly can be located over the lap of the user.

Another objective of the present invention is to construct a TV tray assembly which is constructed of few parts and can be manufactured at a cost substantially equal to the cost for the manufacturing of conventional TV trays.

The TV tray assembly of the present invention includes a substantially flat TV tray which is mounted to one end of a pair of scissor linkages. The mounting of these scissor linkages is substantially closer to the rear edge of the tray than the front edge. The bottom end of each of these scissor linkages is attached to a base. Within the base are located a pair of stabilizing foot members with these foot members to be movable relative to the base to any desired position so that they would not interfere with the bottom of a chair or sofa structure to prevent the locating of the TV tray in an overlapping arrangement with the chair or sofa. Each pair of scissor linkages include a spring biased locking pin arrangement which locks the scissor linkages when the tray is located in its usable position. In the stowage position, the base and the stabilizing foot members, as well as the tray, are located substantially in alignment thereby forming a narrow apparatus facilitating its stowage.

DETAILED DESCRIPTION OF THE SHOWN EMBODIMENT

Figure 1:
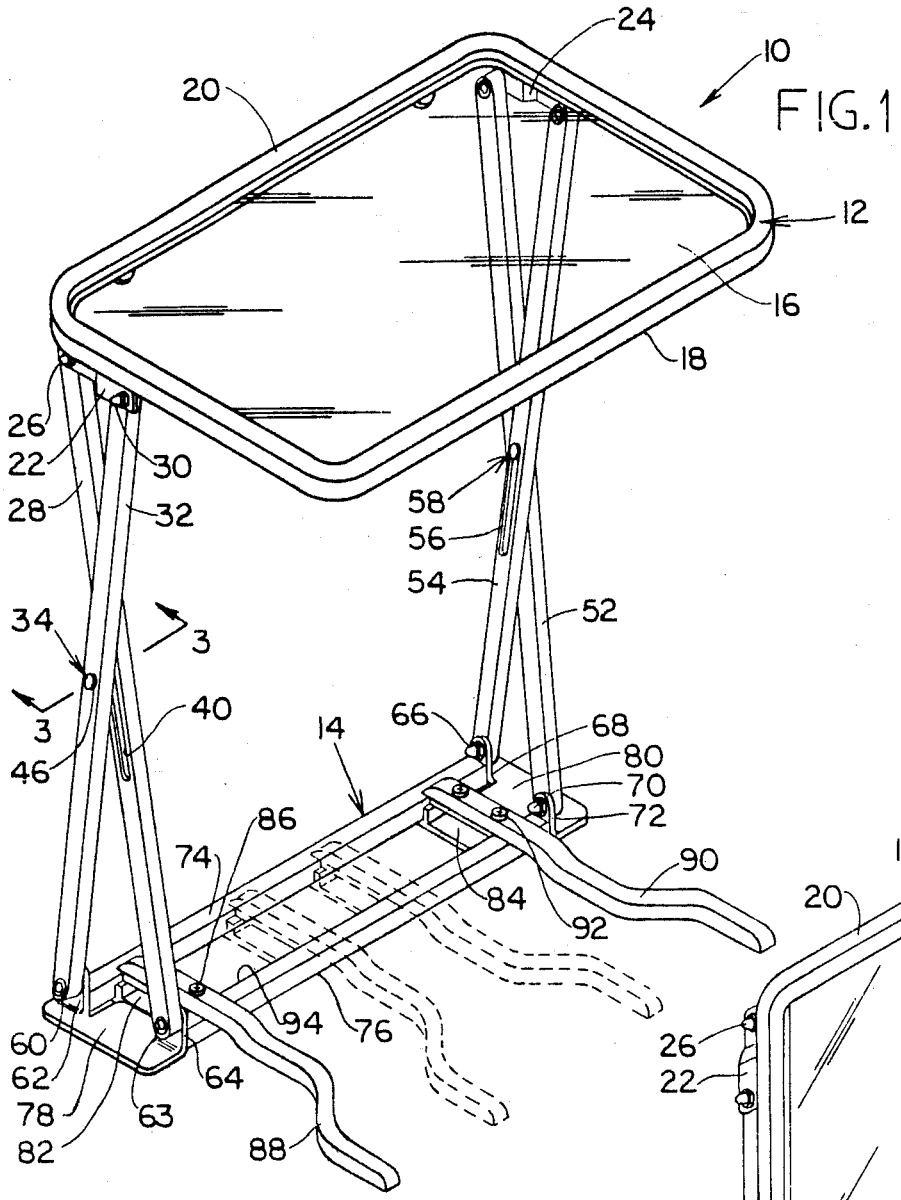
FIG. 1 is an isometric view of the foldable tray assembly of the present invention showing the tray assembly in its usable position.

Referring particularly to the drawing, there is shown the foldable tray assembly 10 of this invention which is composed generally of a tray 12 and a base 14. The tray 12 is defined by a peripheral edge within which is mounted the tray member 16. The tray member 16 is shown to be transparent, such as plastic, within the drawing. However, it is to be understood that in most instances the tray member 16 will not be transparent but will be opaque and may possibly include some form of a design.

The edging of the tray assembly defines a front edge 18 and a rear edge 20. Mounted on the undersurface of the edging and located directly adjacent the rear edge 20 are a pair of mounting brackets 22 and 24. Pivotally mounted to the bracket 22 by a pin 26 is a scissor linkage 28. A similar pin 30 pivotally mounts a scissor linkage 32 to the bracket 22. These scissor linkages 28 and 32 are substantially hollow and are generally formed of tubular bar stock. These scissor linkages 28 and 32 are connected together at their approximate mid-point by a locking pin assembly 34.

The locking pin assembly 34 comprises an elongated locking pin 36 which has a threaded free end which is threadably connected to a cap 38. The elongated locking pin 36 is conducted through an appropriate hole formed within linkage 32. The threaded end of the locking pin 36 also passes through an elongated slot 40 formed within the linkage 28. Located about the elongated locking pin 36 is a coil spring 42. This coil spring 42 operates against the inside wall surface of the link 32 and a shoulder 44 formed on the elongated locking pin 36. The shoulder 44 is integral with an enlarged annular disc 46 which abuts against the exterior surface of the linkage 32.

Figure 3:
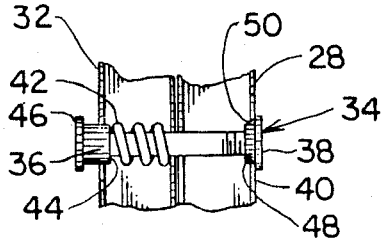
FIG. 3 is a cross-sectional view through the locking pin arrangement associated with each pair of scissor links included within the foldable tray assembly of this invention taken along line 3—3 of FIG. 1.
Figure 2:
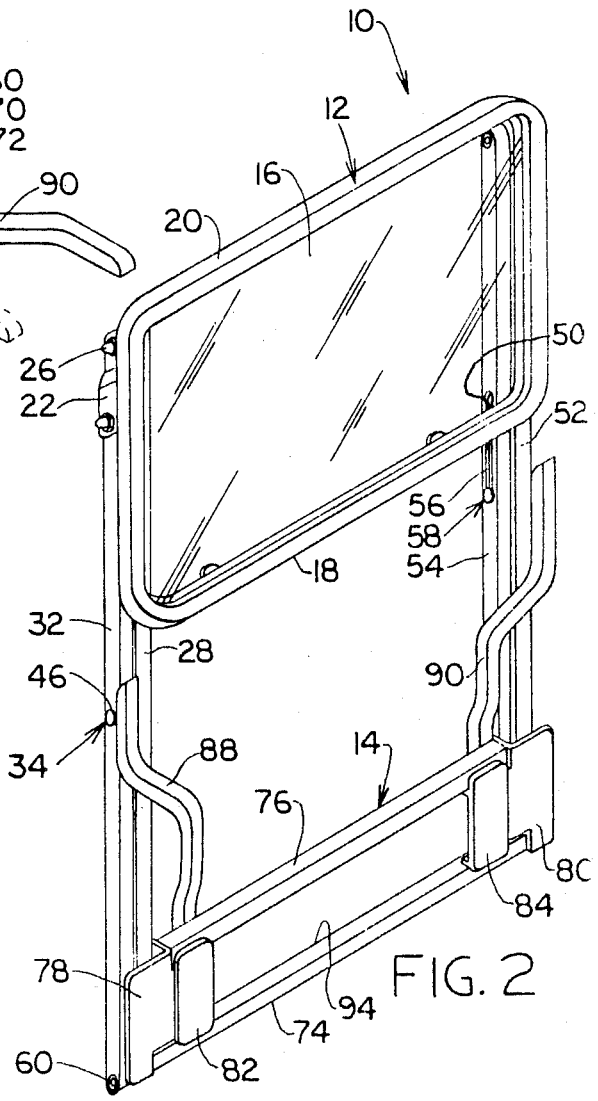
FIG. 2 is an isometric view of the foldable tray assembly of the present invention showing the tray assembly in its stowage position.

The normal bias of the spring 42 is to locate the disc 46 slightly spaced from the wall surface of the linkage 32 as is clearly shown in FIG. 3 of the drawing. This position is known as the locking position with the annular shoulder 48 of the cap 38 closely conforming with the upper end of the slot 40 which is slightly enlarged forming enlargement 50. With the shoulder 48 located within the enlargement 50, the linkages 28 and 32 are fixedly positioned relative to each other in the position shown in FIG. 1 of the drawing. If the disc 46 is manually moved against the linkage 32, the shoulder 48 will cause to be disengaged from the enlargement 50 which will permit the pin 36 to be moved within the slot 40. This will permit the scissor linkages 28 and 32 to be located in juxtaposition as is shown in FIG. 2 which is the stowage position of the tray assembly 10.

Attached to the bracket 24 are a similar pair of linkages 52 and 54 with linkage 54 including elongated slsot 56. Connecting the linkages 52 and 54 is a pin assembly 58 which is identical to pin assembly 34 and is operated in the same manner. For a detailed description of the pin assembly 58, reference is to be had to the description of pin assembly 34.

The bottom end of the link 32 is pivotally connected by a pin 60 to a bracket 62. In a similar manner the bottom end of the link 28 is pivotally connected by means of a pin 63 to a bracket 64. In a similar manner, the bottom end of the link 54 is pivotally connected by means of a pin 66 to a bracket 68. Still further, the bottom end of the link 52 is pivotally connected by means of a pin 70 to a bracket 72. Connected between the brackets 62 and 68 is a tubular rod 74. A similar tubular rod 76 connects brackets 64 and 72. The brackets 62 and 64 are formed integral with a left base flange 78. The brackets 68 and 72 are integrally formed as part of a right base flange 80. The left base flange 78, the right base flange 80, and the tubular bars 74 and 76 form, in essence, what is to be referred to as the base 14. It is noticed that the upper surface of the base 14, as shown i nFIG. 1, is parallel to the upper or top surface of the tray 12. It also is to be noted that the upper surface of the base 14 is substantially less in are than the usable area of the tray 12. The reason for this is so as to minimize the area of the base 14 so that it can be moved closer to the base structure of a chair or sofa (not shown). When the base 14 is moved closer to the chair or sofa, the tray 12 is located in a cantilevered position over the lap of the user (not shown).

Mounted between the tubular rods 74 and 76 and against the undersurface thereof is an attaching flange 82. A similar attaching flange 84 is located in a similar position but spaced from attaching flange 82. fixedly connected by conventional fasteners 86 to the attaching flange 82 is an elongated narrow foot member 88. A similar foot member 90 is fixedly mounted by means of fasteners 92 to the attaching bracket 84. The foot member 88 is located against the upper surface of the tubular rods 74 and 76 as is also the member 90.

The connection between the member 88 and its respective attaching flange 82, and also the member 90 and its respective attaching flange 84, is such that sliding movement is permitted of the members 88 and 90 within the elongated slot 94 formed between the tubular members 74 and 76. This sliding movement is generally depicted in phantom lines within FIG. 1. It is to be understood that if either member 88 or 90 interferes with the legs or base of the chair with which it is to be located against, that the members 88 and 90 can be moved to a position so as to not interfere thereby permitting the tray 12 to be moved directly over the lap of the user. The members 88 and 90 are curved so that the free outer ends of the members 88 and 90 would have their bottom surface to be located substantially horizontal with the bottom surface of the base 14. Therefore, with the tray assembly 10 in the usable position, as shown in FIG. 1, the upper surface of the tray 12 will be located horizontal.

When folding of the tray assembly 10 into the stowage position, the members 88 and 90 will be automatically moved to be substantially in alignment with the upper surface of the tray 12 as is also the base 14.

What is claimed is:

1. A foldable tray assembly comprising:

a tray having a substantially planar upper surface defining a usable area;

a scissor linkage assembly attached to said tray;

a base, said base having a top surface, said scissor linkage assembly being attached to said base, said tray assembly being movable between a usable position and a stowage position, with said tray assembly being in said usable position said top surface being substantially parallel to and not aligned with said upper surface, with said tray assembly being in said stowage position said top surface being in substantial alignment with said upper surface; and a stabilizing foot assembly mounted on said base and extending outwardly therefrom, whereby when said tray assembly is in said usable position both said base and said stabilizing foot assembly rest against the surface upon which it is supported.

2. The foldable tray assembly as defined in claim 1 wherein:

said tray having a forward edge and a rearward edge, said scissor linkage being attached to said tray at said rearward edge and being spaced a substantial distance from said forward edge.

3. The foldable tray assembly as defined in claim 2 wherein:

the area of said top surface being substantially less than said usable area.

4. The foldable tray assembly as defined in claim 3 wherein:

a locking means connected to said tray assembly, said locking means fixing the established position of said tray assembly when in said usable position.

5. The foldable tray assembly as defined in claim 4 wherein:

said locking means including a locking pin assembly connected in conjunction with said scissor linkage assembly.

6. The foldable tray assembly as defined in claim 5 wherein:

said scissor linkage assembly comprising two pair of spaced apart parallel oriented scissor linkages.

7. The foldable tray assembly as defined in claim 1 wherein:

said base including an elongated slot, said stabilizing foot assembly comprising a pair of stabilizing foot members, each said stabilizing foot member being movably mounted within said slot, each said stabilizing foot member to be adjusted within said slot.

8. The foldable tray assembly as defined in claim 7 wherein:

the area of said top surface being substantially less than said usable area.

9. The foldable tray assembly as defined in claim 8 wherein:

a locking means connected to said tray assembly, said locking means fixing the established position of said tray assembly when in said usable position.

10. The foldable tray assembly as defined in claim 9 wherein:

said locking means including a locking pin assembly connected in conjunction with said scissor linkage assembly.

* * * * *